United States Patent [19]

Deutsch

[11] 4,411,185

[45] Oct. 25, 1983

[54] TOUCH RESPONSIVE KEYBOARD ELECTRONIC MUSICAL INSTRUMENT

[75] Inventor: Ralph Deutsch, Sherman Oaks, Calif.

[73] Assignee: Kawai Musical Instrument Mfg. Co., Ltd, Hamamatsu, Japan

[21] Appl. No.: 364,955

[22] Filed: Apr. 2, 1982

[51] Int. Cl.[3] ..... G10H 1/34; G10H 1/46

[52] U.S. Cl. ..... 84/1.27; 84/1.1

[58] Field of Search ..... 84/1.09, 1.1, 1.27

[56] References Cited

U.S. PATENT DOCUMENTS

| | | | |
|---|---|---|---|
| 4,018,125 | 4/1977 | Nishimoto | 84/1.27 X |
| 4,067,253 | 1/1978 | Wheelwright et al. | 84/1.1 |
| 4,080,863 | 3/1978 | Groeschel | 84/1.27 |
| 4,121,490 | 10/1978 | Deutsch | 84/1.27 |
| 4,195,545 | 4/1980 | Nishimoto | 84/1.27 X |
| 4,333,376 | 6/1982 | Moore et al. | 84/1.27 |
| 4,333,377 | 6/1982 | Niezgoda et al. | 84/1.27 |

*Primary Examiner*—Stanley J. Witkowski
*Attorney, Agent, or Firm*—Ralph Deutsch

[57] ABSTRACT

A touch responsive keyboard musical instrument is provided with an array of keyboard switches arranged in octave groups and connected in parallel octaves. A motion transducer is attached to each keyswitch so that a transducer signal is generated corresponding to the motion used to actuate the keyswitches. The keyswitches are sequentially scanned until an actuated keyswitch is detected. At this time the scanning is interrupted until the corresponding transducer signal has reached its peak value. The peak value is used to vary a tonal effect such as a frequency modulation or an ADSR envelope modulation of a tone generator assigned to the actuated keyswitch. The keyswitch scanning is resumed when the peak value of the transducer signal has been measured.

10 Claims, 7 Drawing Figures

59
STATE F/F
S
R
Q
80
76
101
TRANSDUCER MULTIPLEXER
102
ANALOG TO DIGITAL CONVERTER
104
PEAK DETECTOR
81
PEAK
64
NOTE COUNTER (MODULO 12)
65
106
CONTROL DATA MEMORY
119
87
66
CLOCK COUNTER (MODULO 12)
83
MEMORY ADDRESS DATA WRITE
103
56
MASTER CLOCK
62

TOUCH RESPONSIVE KEYBOARD ELECTRONIC MUSICAL INSTRUMENT

BACKGROUND OF THE INVENTION

1. Field of the Invention

This invention relates to electronic keyboard operated musical instruments and in particular is concerned with a touch responsive keyboard instrument.

2. Description of the Prior Art

Keyboard musical instruments such as the organ and harpsichord are characterized by a purely mechanical type of tone production. The musician can only control the times of tone initiation and tone cessation. The musician playing these instruments can introduce no instantaneous volume changes as an additional tone dimension to provide an expressive emotion effect to the individual musical tones. Rapid loudness control of individual tones is an inherent characteristic of most orchestral instruments. In particular, the acoustic piano has evolved to its present form and acceptance primarily because of the ease whereby a wide dynamic loudness range can be given to individual notes in response to the player's skill in actuating the key-hammer combination mechanism.

A requirement for implementing a touch responsive keyboard electronic musical instrument is a transducer to convert tactile motion into an electrical control signal. The transducers can include devices which are velocity sensitive and produce an electrical signal proportional to the speed in which a keyboard switch is depressed. Alternatively the transducer can be implemented to respond to pressure used to close a keyswitch. Transducers can also be used to sense the lateral motion of pivoted keyboard switches to provide control signals to produce tonal effects such as vibrato, glide, and pitch bend.

In U.S. Pat. No. 4,121,490 a transducer is disclosed in which the operation of a keyswitch mechanism produces an air stream having a velocity proportional to the applied force on the keyswitch. A velocity sensitive device converts the air stream motion into an electrical control signal which has a peak amplitude proportional to the peak velocity of the air flow. This signal is used to determine the loudness of the corresponding musical tone for the actuated keyswitch.

An organ-type keyboard comprises 61 keyswitches and a piano-type keyboard comprises 88 keyswitches. The number of keyswitches imposes a practical design requirement to share the electrical circuits instead of using a large number of identical circuits each of which is assigned permanently to a given keyswitch.

The output signal from most touch sensitive transducers is an analog signal. For a digital tone generator as well as for some analog tone generators, it is necessary to convert the output signal from the transducer into a binary digital number. The relatively high cost of an analog-to-digital converter has led to systems in which either one, or a small number of analog-to-digital converters are assigned on demand to transducers associated with actuated keyswitches.

A time shared method of assigning a single analog-to-digital converter to a multiplicity of transducers is disclosed in the referenced U.S. Pat. No. 4,121,490. U.S. Pat. No. 4,018,125 discloses a method of time division multiplexing a number of transducer output signals to a single converter.

The assignment of the available analog-to-digital converters should be accomplished in a fashion which minimizes the time required to generate a set of digital control signals for the array of keyboard switches. Experimentally it has been determined that all the keyboard input data should be acquired in no more than 5 milliseconds after any keyswitch has been actuated. A range of about 3 to 5 milliseconds has been found to be suitable for the data acquisition cycle time for a keyboard. This implies that the entire keyboard input switch data should be acquired in no more than 5 milliseconds and that the data acquisition cycle should be repeated with a time lapse of not more than 5 milliseconds. Since there are 88 keyswitches used in a piano keyboard, there is only $0.005/88=56.8$ microseconds as a maximum time to be allotted to each key if a conventional time division multiplexed key assignor system is used to acquire keyswitch data. This is also the maximum time that would be available for an analog-to-digital conversion of the transducer signal output associated with any of the actuated keyswitches.

57 microseconds is a relatively short time to allot for an analog-to-digital signal conversion. For example, consider the situation in which note $C_4$ has been actuated just as the time division multiplex signal has reached the immediate prior time slot corresponding to $B_3$. This leaves only a maximum of 56.8 microseconds for the transducer's output to reach its peak value before the $C_4$ time slot is reached and the analog-to-digital conversion is started for the touch response signal corresponding to $C_4$. This timing situation rapidly degenerates if the $C_4$ keyswitch happens to be actuated after the $B_3$ time slot is started but before the $C_4$ time slot is reached.

SUMMARY OF THE INVENTION

In a keyboard operated electronic musical instrument having a linear array of keyswitches a touch sensitive transducer is mechanically coupled to each of the keyswitches to generate an electrical signal corresponding to a motion of the keyswitch produced by the player's fingers in contact with the keyswitches. A keyswitch scanning logic circuitry is provided for scanning the array of keyswitches thereby generating signals corresponding to actuated switches (closed contact condition). The keyswitch scanning is interrupted each time that a keyswitch is detected to be in its actuated state. The interruption is maintained until the output signal from the associated transducer has reached its peak value. A logic is provided so that the interruption is rapidly terminated if the transducer has already reached its peak value at some previous time or previous keyboard scan. When the output of the transducer is verified to be at its maximum value, the output signal is converted to a binary digital number and the key scan interrupt is terminated. After the conversion process has been completed the transducer's output signal is initialized to a prespecified signal level.

It is an object of the present invention to provide a digital control signal which can be used to control the production of tone in an electronic musical instrument in response to a signal output from a touch sensitive transducer.

It is a further object of the present invention to provide a means for assuring that the peak value data output is obtained from each touch sensitive transducer independent of the instant at which the associated keyswitch has been actuated relative to the scanning action of the keyswitch scanning system.

It is a further object of the present invention to provide a means for obtaining a digital touch control signal which removes the severe fast time requirements that arise from the use of a keyswitch scanning system employing time division multiplexing.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed to a subsystem for obtaining a digital control signal proportional to the peak signal produced by a touch sensitive transducer mechanically coupled to keyboard switches in a keyboard operated electronic musical instrument and to apply this digital control signal to vary a musical tone effect.

Figure 1:
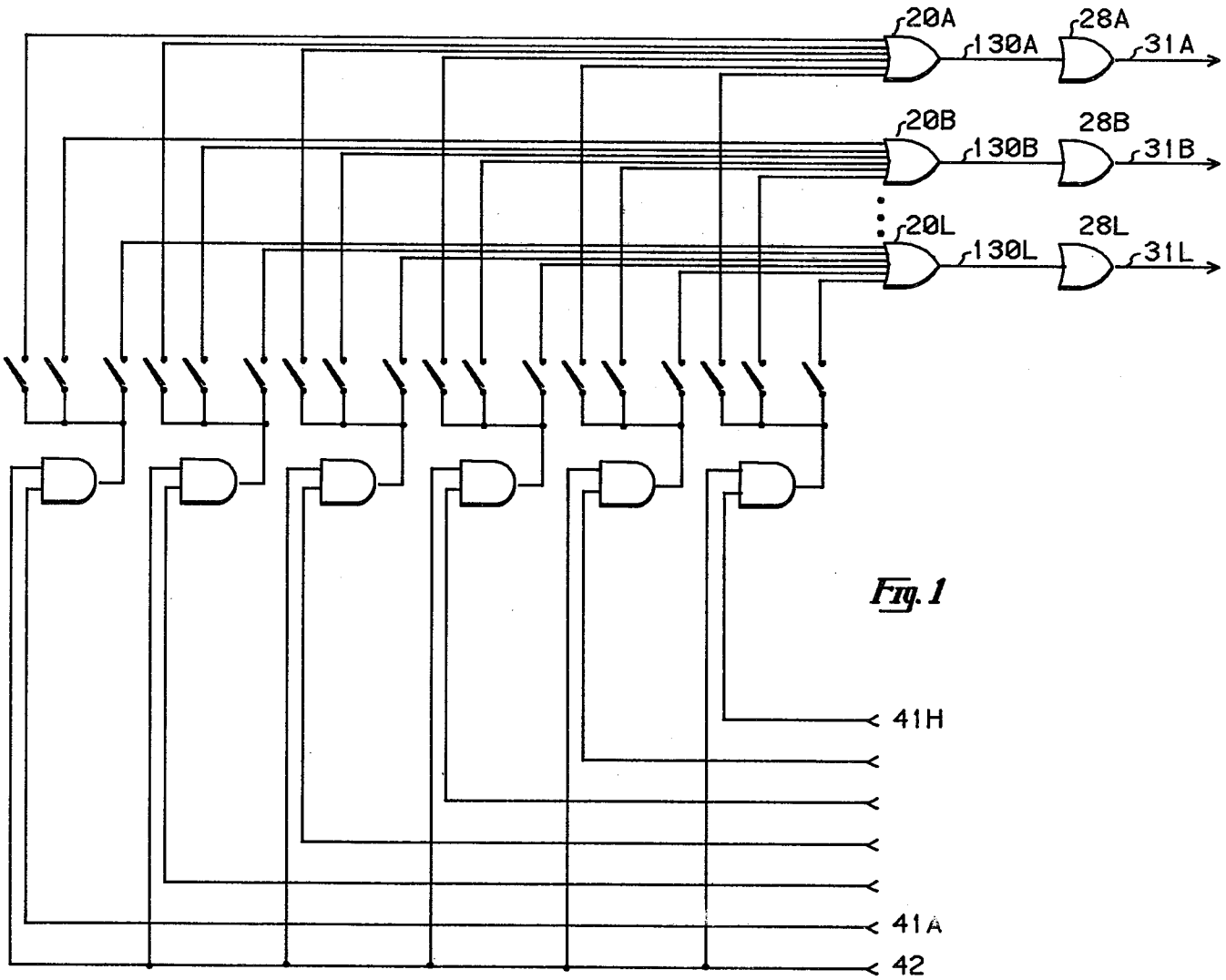
FIG. 1 illustrates the keyswitch scanning logic.

FIG. 1 illustrates a logic used to scan a linear keyboard array of keyswitches to generate signals corresponding to keyswitches that have been moved to their actuated states. The keyswitches are arranged in H groups of 12 keyswitches. Each of these groups corresponds to a musical octave. The switches within a group correspond to musical notes within an octave.

The output signals from the array of keyswitches are connected in a connection pattern that is called "parallel octaves." That is, all the C switches from the various groups are all summed in the OR-gate 20A; all the C# switches are summed in the OR-gate 20B; and so on for the remainder of the musical octave.

Figure 2:
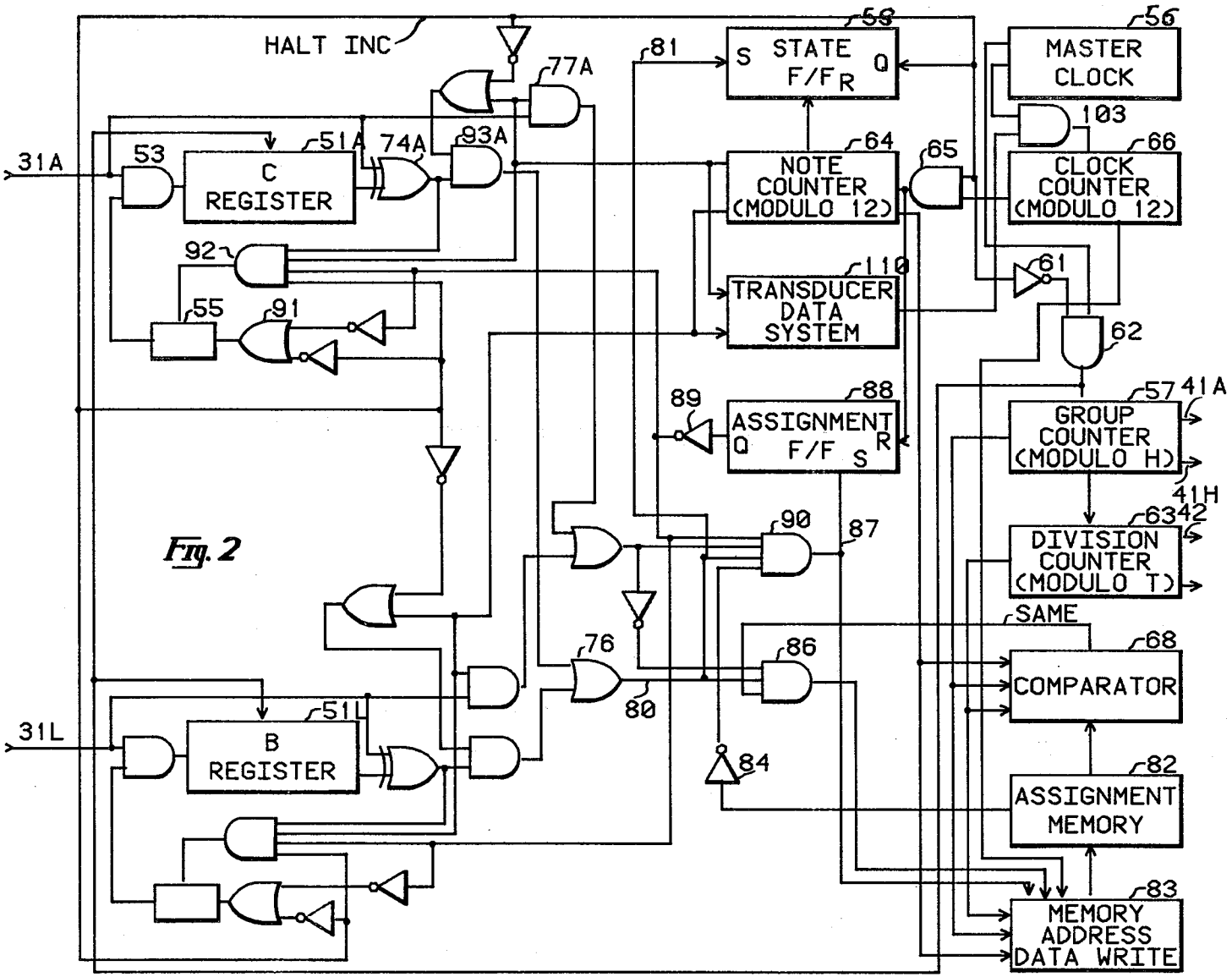
FIG. 2 illustrates the note detect and assignor system.

FIG. 2 illustrates the detailed logic of a note detect and assignor system that is suitable for detecting the actuated keyswitches and then to assign members of a set of tone generators to the actuated keyswitches. This system is a modification to the system shown in FIG. 2 of U.S. Pat. No. 4,022,098 entitled "Keyboard Switch Detect And Assignor." This patent is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to implement the improvements of the present invention. The connections shown here in FIG. 1 correspond to the switch arrangement described in the referenced patent.

The group counter 57 is implemented to count modulo H where H is the number of musical octaves spanned by the keyswitches associated with a keyboard array of keyswitches. The division counter 63 is implemented to count modulo T where T is the number of keyboards provided for in the musical instrument.

Figure 3:
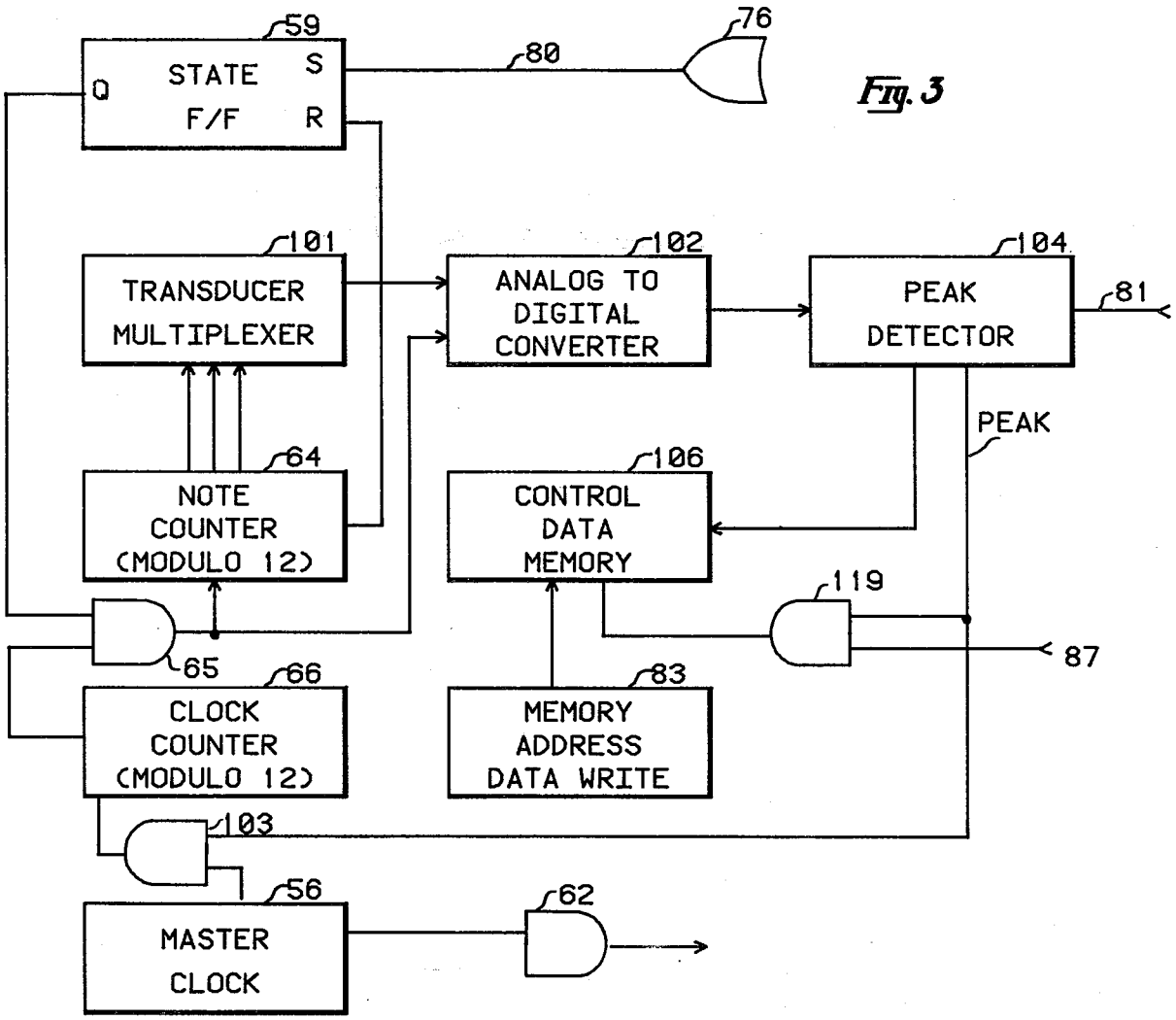
FIG. 3 is a block diagram of the transducer data system 110.

The system elements added here in FIG. 2 are the transducer data system 110 and the AND-gate 103. The purpose of the AND-gate 103, as detailed below, is to keep the system in its assignment mode for a given state of the note counter 64 until the analog-to-digital converter 102 (FIG. 3) output indicates that the current assigned transducer signal has attained its maximum value. The details of the transducer data system 110 are shown in FIG. 3.

Attached to each keyboard switch contained in a keyboard array implemented for touch sensitive musical effects is a touch sensitive transducer. An example of such a transducer is described in U.S. Pat. No. 4,121,490 entitled "Touch Responsive Electronic Piano." This patent is hereby incorporated by reference. The function of the transducer is to provide a signal which corresponds to the motion imparted to actuate the corresponding keyswith.

Figure 4:
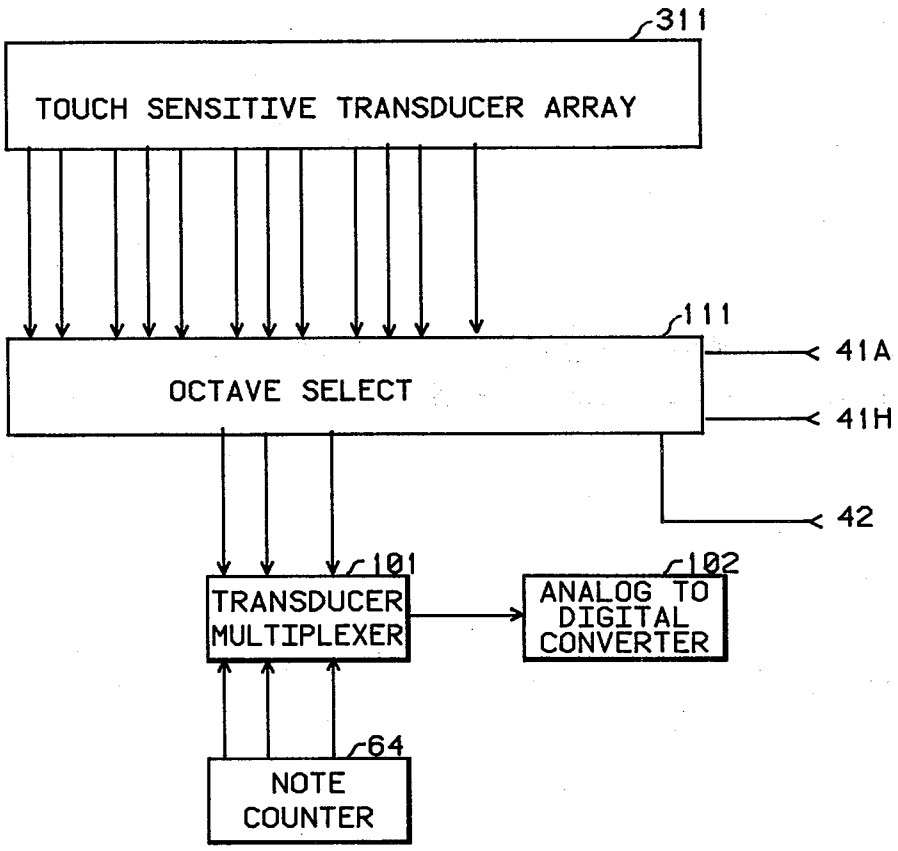
FIG. 4 shows the transducer multiplexing subsystem.

As shown in FIG. 4, the analog signals from the touch sensitive transducer array 311 are connected to the octave select 111. The touch sensitive transducer array contains the collection of individual touch sensitive transducers. For illustrative purposes, it is assumed that the touch sensitive transducers are contained in the instrument's keyboard associated with a "1" logic state signal on line 42 from the division counter 63. When a logic "1" state signal appears on line 42, the note detect and assign system (FIG. 2) is ready to examine the signals produced by the array of touch sensitive transducer associated with the touch sensitive keyboard and to examine the switch states of the corresponding keyswitches. When a keyswitch is actuated, the scanning signals from the note detect and assignor system will generate a detection signal.

The group counter 57 binary states are decoded onto the set of signal lines 41A to 41H. The octave select 111 transfer a selected octave of transducer signals to the transducer multiplexer 101 in response to the count state of the group counter 57. The states of the note counter 64 are used to select transducer signals from the transducer multiplex which correspond to the notes within a musical octave.

The transducer data system 110 logic is detailed in FIG. 3. A logic "1" signal on line 80 sets the state flip-flop 59 and places the system in its assign mode. When the state flip-flop 59 is set, the HALT INC signal is placed in its logic "1" binary state. The HALT INC signal is also called the assign signal because when it exists the system is in its assign mode of operation. When the HALT INC signal is not present, the system is in its search mode of operation.

While the HALT INC signal is in its "1" logic state, the AND-gate 65 transfers timing signals from the clock counter 66 which increment the count state of the note counter 64. The binary count states of the note counter 64 are decoded onto 12 signal lines which control the selection of transducer data in the transducer multiplexer 101. The data selected by the transducer multiplexer 101 is transferred to the analog-to-digital converter 102.

The analog-to-digital converter 102 starts to convert its input analog data in response to a clock timing signal transferred by the AND-gate 65. The input analog data is repetitively converted into binary digital numbers at a fast rate and the output digital numbers are transferred to the peak detector 104.

Figure 5:
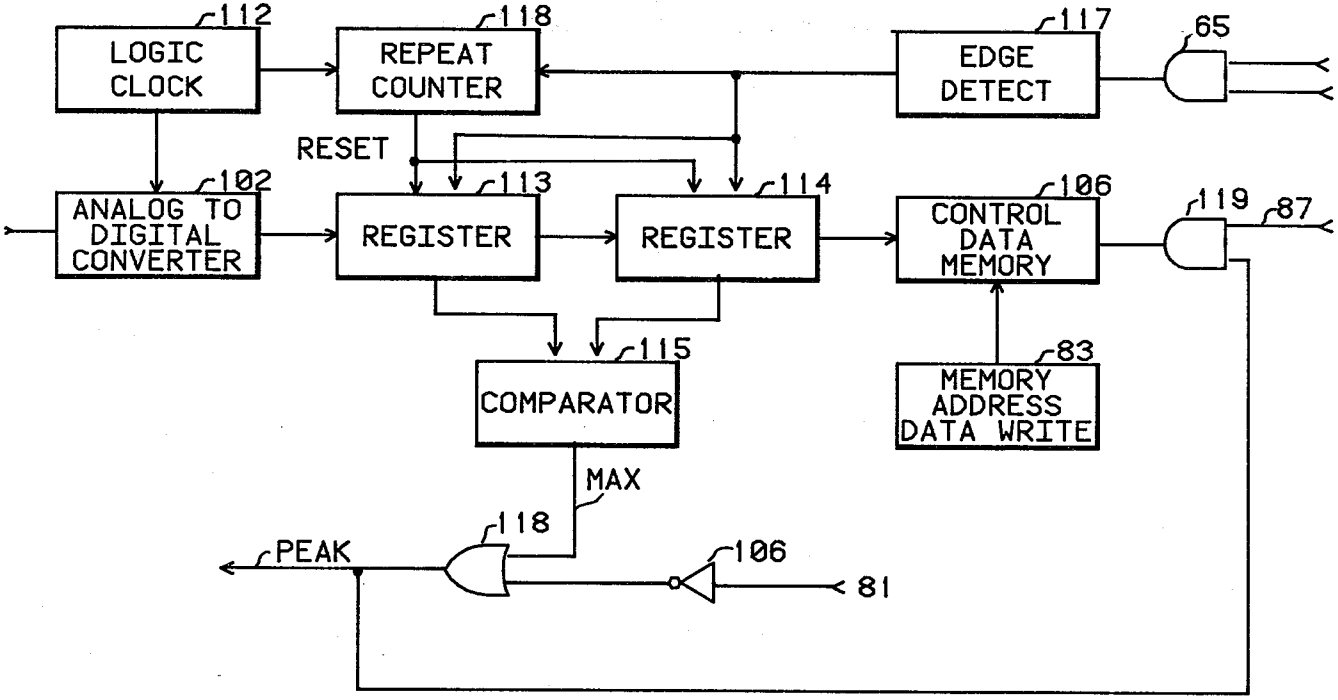
FIG. 5 illustrates the logic for the peak detector 104.

FIG. 5 illustrates the logic details of the peak detector 104. The peak detector 104 is a means for detecting the maximum value of a time varying signal such as that produced by the motion transducers. The logic clock 112 is used to time the logic operations of the analog-to-digital converter 102. To provide synchronous logic system operation, the master clock 56 can be implemented as a counter driven by the logic clock 112.

The repeat counter 118 is a counter which is implemented to count modulo the maximum number of timing pulses required by the analog-to-digital converter 102 to reach its final conversion value. In response to a timing signal transferred by the AND-gate 65, the edge detect 117 creates a pulse signal. The output signal from the edge detect 117 resets the repeat counter 118 to its initial count state and also clears the contents of register 113 and 114 so that they contain a zero value.

Each time that the repeat counter 118 is reset to its initial count state because of its modulo counting implementation, a RESET signal is generated. In response to this RESET signal, the content of register 113 is transferred to register 114 and the current output value from the analog-to-digital converter 102 is stored in the register 113.

The contents of register 113 and register 114 are compared in magnitude by means of the comparator 115. If the contents of both registers are equal or if the value in register 114 is greater than the value in register 113, comparator 115 generates a MAX signal.

The MAX signal is transferred via OR-gate 118 to create a PEAK signal. If the PEAK signal is generated, and the signal on line 87 is in a logic binary state of "1", then the content of register 114 is stored in the control data memory 106 at an address created by the memory address data write 83. The stored data is called the tone control signal and is used by the musical tone generators to produce a variable musical tone effect. Line 87 will have a binary logic state of "1" if the note detect and assignor system shown in FIG. 2 has detected a switch closure which is a switch state change from that detected on the immediate prior scan of the keyboard division containing that keyswitch.

If the current count state of the note counter 24 corresponds to a keyswitch in the current scanned keyswitch group (octave) which is in its unactuated state (keyswitch open) the signal on line 81 will be in a binary "0" logic state. The inverter gate 106 and the OR-gate 118 will convert such a binary "0" signal into a PEAK signal. In this fashion, when a keyswitch is found in an unactuated state the system quickly bypasses the switch without wasting time to perform an analog-to-digital signal conversion.

The logic shown in FIG. 5 serves to detain the note detect and assign subsystem at a given keyswitch scan location until the corresponding touch sensitive transducer has reached either its peak signal value or finds its output in a steady state condition. This steady state condition embraces the zero output signal condition as well as a peak signal value. The logic prevents the generation of erroneous touch control data because of the lack of any synchronism between the actuation of a keyswitch and the time at which the output signal from the corresponding transducer can be converted into a digital control signal.

As shown in FIG. 3, AND-gate 103 will only transfer a signal from the master clock 56 if the PEAK signal has been generated in the fashion previously described.

The analog signal produced by each transducer is usually stored in an analog memory such as a capacitor whose charge serves as the storage means. The analog signal stored at the output of each transducer is advantageously reset to a zero initial value as soon as its peak value has been measured and the corresponding digital control number has been stored in the control data memory 106. In this fashion the touch sensitive transducers are rapidly replaced into a data reception mode.

Figure 6:
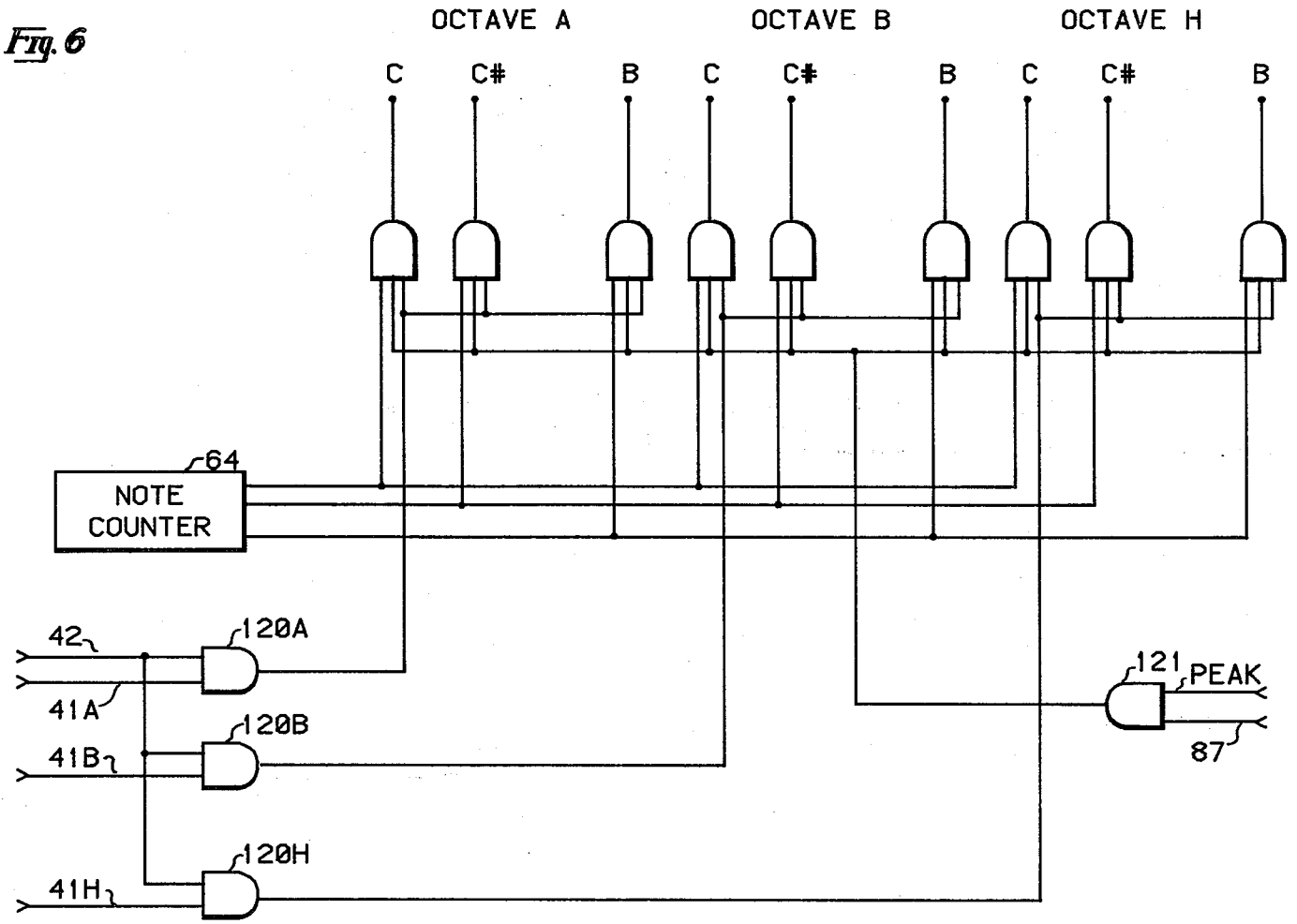
FIG. 6 shows the transducer output initializing subsystem.

FIG. 6 illustrates the system logic for restoring, or initializing, the touch sensitive transducer output analog signals to an initial value. The initial value is usually a zero value. The dots at the top of FIG. 6 represent an input signal line to each of the transducers associated with the array of keyboard switches. A signal on any of these input signal lines will initialize the transducer's output signal.

The binary state of the note counter 64 is decoded onto 12 lines which are connected to the set of transducer AND-gates. These lines are connected in parallel octaves in a manner analogous to the parallel octave convection of the keyswitches shown in FIG. 1. The set of AND-gates 120A–120H provide successive octave signals to the transducer AND-gates when a signal is present on line 42. A signal is present on line 42 when the note detect and assign system is scanning the keyswitch states for the keyboard containing the touch sensitive transducers. AND-gate 121 will generate a binary "1" logic signal when both the PEAK signal and line 87 are in the binary logic state "1". This arrangement provides a reset of a transducer in preparation for a new signal as soon as the preceding data value has been converted and stored in the control data memory 6.

Figure 7:
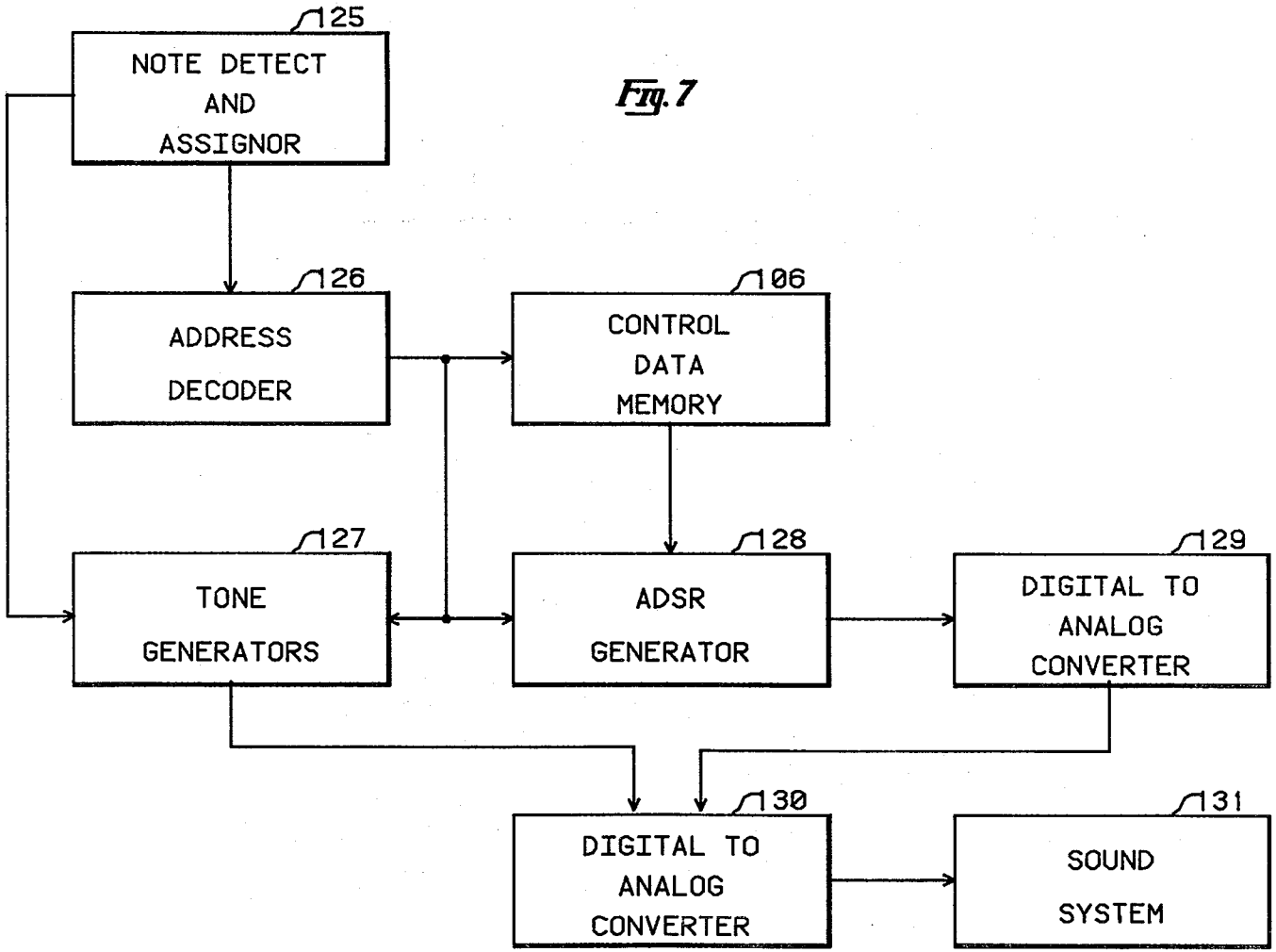
FIG. 7 illustrates a touch responsive musical instrument.

FIG. 7 shows a system block diagram for a touch responsive musical instrument such as a piano. The assignment data stored in the assignment memory 82, contained within the note detect and assignor 125, is decoded into memory addresses by means of the address decoder 126. The output from the address decoder 126 is combined with the assignment data from the note detect and assignor 126 and the result is used to select and assign tone generators contained in the set of tone generators 127.

Control data is addressed out of the control data memory 106 in response to the addresses provided by the address decoder 126. The accessed control data values are used by the ADSR generator 128 to create amplitude envelope signals which are provided to the output of the assigned tone generators. A suitable implementation of the ADSR generator 128 is described in U.S. Pat. No. 4,214,503 entitled "Electronic Musical Instrument With Automatic Loudness Compensation." This patent is hereby incorporated by reference. In the system described in the referenced patent, the amplitude of each of a plurality of ADSR envelope functions corresponds to a stored input curve parameter $A_0$. The system shown in FIG. 7 uses the data values read out of the control data memory 106 for the values of $A_0$ in the ADSR generator 128.

The output ADSR digital values provided by the ADSR generator 128 are converted into analog signals by means of the digital-to-analog converter 129. These analog signals are used as the reference voltages for the digital-to-analog converter 130 which converts the digital waveshape data provided by the assigned tone generators into analog musical waveshapes. The digital-to-analog converter 130 is operated as a multiplying signal converter. The analog signals produced by the digital-to-analog converter 130 are provided to the sound system 131.

The previously described system can be used to also provide touch sensitive control for a variety of musical tonal effects such as vibrato, pitch bend, and portamento.

I claim:

1. In an electronic musical instrument having a keyboard comprising an array of keyboard switches, each operable in an unactuated or an actuated keyswitch state, apparatus for producing musical tones having musical tone effects responsive to the motions imparted to actuate said keyswitches comprising:

a plurality of motion transducers each of which is associated with a corresponding one of said keyboard switches whereby a transducer signal is generated by each motion transducer in response to the motion imparted to actuate its corresponding keyboard switch, a detection means whereby a detection signal is generated corresponding to each said keyboard switch operated in its actuated keyswitch state, a plurality of tone generators for creating musical tones each of which produces a musical tone effect in response to a tone control signal, a maximum signal detection means whereby one said tone control signal is generated corresponding to the maximum value of each said transducer signal, and an assignor means responsive to each said detection signal for assigning tone generators in said plurality of tone generators to actuated keyswitches and for assigning a corresponding tone control signal to each said assigned tone generator thereby producing said musical tones having musical tone effects responsive to the motions imparted to actuate said keyswitches.

2. Apparatus according to claim 1 wherein said detection means comprises:

a system mode generation means for generating a search signal in response to a peak signal and for generating an assign signal in response to said detection signal, a keyboard scanning means responsive to said search signal for providing scanning signals to said array of keyboard switches, a detection generator means responsive to said scanning signals for generating said detection signal corresponding to each said keyswitch operated in an actuated keyswitch state, and a scanning inhibit means interposed between said system mode generation means and said keyboard scanning means whereby said search signal is not provided to said keyboard scanning means if said assign signal is generated.

3. Apparatus according to claim 2 wherein said array of keyboard switches are arranged in octave groups corresponding to the notes in a musical octave and wherein said assignor means comprises:

an assignment memory means for storing assignment data words, an encoding means responsive to said assign signal whereby each said detection signal is encoded to form one said assignment data word which identifies the octave group and musical note of the corresponding actuated keyswitch, a first memory addressing means for writing said assignment data word encoded by said encoding means into said assignment memory means, and a tone generator assign means whereby said plurality of tone generators is assigned to the assignment data words stored in said assignment memory means.

4. Apparatus according to claim 3 wherein said maximum signal detection means comprises:

a control data memory means for storing each said tone control signal, a signal conversion means responsive to said transducer signal whereby a digital transducer signal is generated, a transducer assign means responsive to said detection signal whereby a transducer signal corresponding to said actuated keyswitch is provided to said signal conversion means, a peak detection means responsive to said digital transducer signal whereby said peak signal is generated when said digital transducer signal attains its maximum value, and a second memory addressing means whereby the maximum value of said digital transducer signal is selected to provide a tone control signal and is stored in said control data memory means.

5. Apparatus according to claim 4 wherein said assignor means further comprises:

a control data assign means responsive to each assignment data word stored in said assignment memory means whereby a tone control signal is read out from said control data memory means and provided to a corresponding one of said plurality of tone generators.

6. Apparatus according to claim 5 wherein said plurality of motion transducers comprises:

a plurality of signal memories, each one of which is associated with a corresponding one of said plurality of motion transducers, and wherein each one of said signal memories stores one said transducer signal.

7. Apparatus according to claim 6 wherein said maximum signal detection means further comprises:

transducer initializing means responsive to said peak signal whereby the corresponding said transducer signal is initialized to a prespecified signal level value.

8. In an electronic musical instrument according to claim 1 wherein each of said plurality of motion transducers generates a transducer signal corresponding to the velocity of the motion used to actuate a corresponding keyboard switch.

9. In an electronic musical instrument according to claim 1 wherein said plurality of tone generators comprises:

a plurality of ADSR function generators, each of which corresponds to one of said plurality of tone generators, wherein an ADSR envelope modulation function is created having a maximum value related to the corresponding said tone control signal.

10. In a keyboard electronic musical instrument, apparatus for producing musical sounds having touch responsive tonal effects comprising:

an array of keyboard switches, each of which is operable in an actuated or unactuated keyswitch state, arranged in octave groups and connected in a parallel octave arrangement, an array of motion transducers each of which is associated with a corresponding keyboard switch in said array of keyboard switches, and wherein each transducer generates a transducer signal in response to the motion used to actuate the corresponding keyboard switch, a plurality of tone generators for producing musical sounds having tonal effects responsive to an assigned tone control signal, a keyboard scanning means for providing scanning signals to said array of keyboard switches, a detection means responsive to said scanning signals whereby a detection signal is generated for each said keyboard switch operated in an actuated keyswitch state, an encoding means whereby each said detection signal is encoded into an assignment data word which identifies the corresponding actuated keyboard switch, an assignment memory means for storing each said assignment data word, a tone generator assign means whereby said plurality of tone generators is assigned in response to the assignment data words stored in said assignment memory means, a maximum signal detection means responsive to said detection signal whereby said tone control signal is generated corresponding to the maximum value of said transducer signal, a control data memory means for storing each said tone control signal, and a memory addressing means whereby a tone control signal is read out of said control data memory means in response to each assignment data word stored in said assignment memory means and provided to a corresponding one of said plurality of tone generators.

* * * * *